US006725570B2

(12) United States Patent
Confoey et al.

(10) Patent No.: US 6,725,570 B2
(45) Date of Patent: Apr. 27, 2004

(54) APPARATUS AND METHOD FOR A CLOTHING DRYER HAVING A FIRE PROTECTIVE SYSTEM

(75) Inventors: Michael W. Confoey, Fall River, MA (US); Dennis Slutsky, Providence, RI (US)

(73) Assignee: American Dryer Corporation, Fall River, MA (US)

( * ) Notice: Subject to any disclaimer, the term of this patent is extended or adjusted under 35 U.S.C. 154(b) by 0 days.

(21) Appl. No.: 10/306,156

(22) Filed: Nov. 29, 2002

(65) Prior Publication Data

US 2003/0150130 A1 Aug. 14, 2003

Related U.S. Application Data

(63) Continuation of application No. 09/929,027, filed on Aug. 15, 2001, now Pat. No. 6,505,418.

(51) Int. Cl.[7] ..... F26B 21/06

(52) U.S. Cl. ..... 34/544; 34/497; 34/138; 34/491; 34/494

(58) Field of Search ..... 34/260, 261, 318, 34/319, 320, 321, 322, 323, 324, 497, 491, 493, 494, 544, 138, 595

(56) References Cited

U.S. PATENT DOCUMENTS

| | | | | |
|---|---|---|---|---|
| 2,470,043 A | * | 5/1949 | Monsarrat | 34/45 |
| 2,996,809 A | | 8/1961 | Shapter | |
| 3,033,546 A | * | 5/1962 | Rosenberg | 263/33 |
| 4,262,430 A | * | 4/1981 | Janson et al. | 34/43 |
| 4,827,627 A | * | 5/1989 | Cardoso | 34/44 |
| 5,197,203 A | | 3/1993 | Lenoir | |
| 5,394,623 A | | 3/1995 | Sewell | |
| 5,396,715 A | | 3/1995 | Smith | |
| 5,443,541 A | | 8/1995 | St. Louis | |
| 5,606,804 A | | 3/1997 | Smith et al. | |
| 5,651,192 A | * | 7/1997 | Horowitz | 34/529 |
| 5,718,062 A | | 2/1998 | de Vroome | |
| 5,755,041 A | * | 5/1998 | Horowitz | 34/491 |
| 6,047,486 A | | 4/2000 | Reck et al. | |
| 6,154,978 A | | 12/2000 | Slutsky | |
| 6,158,148 A | * | 12/2000 | Krausch | 34/497 |
| 6,334,267 B1 | * | 1/2002 | Slutsky | 34/606 |

FOREIGN PATENT DOCUMENTS

| | | |
|---|---|---|
| JP | 5-137897 | 3/1991 |

* cited by examiner

*Primary Examiner*—K. B. Rinehart
(74) *Attorney, Agent, or Firm*—Connolly Bove Lodge & Hutz LLP

(57) ABSTRACT

A clothes dryer having a fire protection system. The clothes dryer chamber has an inlet which receives drying air and an exhaust for removing moisture laden air. The temperature within the drying chamber is monitored, and a determination is made from the dryer electronic controller whether or not a fire exists in the tumbler. The fire detection conditions are based on determining whether a certain temperature rise exists within the tumbler when the drying air ceases. The fire suppression system when activated will inject a fire suppressing substance into the tumbler for suppressing the fire.

16 Claims, 5 Drawing Sheets

APPARATUS AND METHOD FOR A CLOTHING DRYER HAVING A FIRE PROTECTIVE SYSTEM

This application is a continuation of Ser. No. 09/929,027, now U.S. Pat. No. 6,505,418 filed Aug. 15, 2001.

BACKGROUND OF THE INVENTION

The present invention relates to an apparatus and method for providing fire protection when drying clothes with heated air. Specifically, a fire protection system is described for a clothes dryer which includes a fire suppression system that is enabled by the dryer electronic controller based on signals received from temperature sensors which monitor the internal temperature of the dryer to determine whether a fire exists within the tumbler.

Conventional clothes dryers comprise a tumbling chamber into which a load of wet clothing is inserted. The chamber includes a tumbler which is rotated to effect tumbling of the clothes. In reversing type clothes dryers, the clothes may be tumbled in two directions. In either type of clothes dryer, a stream of hot air from an electric heater or gas fired burner, or steam heated air, is forced through the tumbler which removes the moisture contained in the clothing. Recently, microwave heated air has also been used to dry the clothes.

A particular problem in detecting fires in the tumbler occurs because fires may begin during drying, but not increase to a noticeable level until only after the dryers cycle is complete. Normal over temperatures exhaust conditions are monitored during drying, but once drying has ended, a smoldering load of dried clothes may remain undetected.

SUMMARY OF THE INVENTION

The present invention provides a method and apparatus for suppressing a fire within a clothes dryer. A fire protection system has temperature sensors or probes which monitor the internal temperature of the tumbler and enable the dryer electronic controller to determine whether a fire exists within the dryer. If a fire exists within the dryer, the electronic controller enables a fire suppression system to extinguish the fire.

In one embodiment of the clothes dryer of the present invention, the fire protection system may include a first sensor for producing a signal representing the internal temperature of the rotating clothes, and a second sensor for producing a signal representing the temperature of the exhaust air. The electronic controller is connected to the first and second sensors to determine from signals produced by the first and second temperature sensors whether a fire exists in the dryer, and subsequently enables the fire suppression system in response to the fire detection.

In an apparatus and method according to a preferred embodiment of the present invention, the electronic controller enables the fire suppression system if the temperature within the chamber is determined to be increasing and the temperature increase exceeds a threshold differential. When the fire suppression system is activated, the electronic controller may also enable the tumbling of the tumbler to avoid blockage of extinguishing material by a rib of the tumbler, and also to expose burning clothes to the fire suppression material. A timing interval may be utilized to disable the fire suppression system if the probe temperature no longer indicates that a fire is present within the tumbler.

In another embodiment according to the present invention, during the drying cycle, a sensor successively produces a signal representing the exhaust air of the clothes dryer. The electronic controller of the fire protection system enables the fire suppression system if the exhaust air temperature is above a specific set point, or if the exhaust air temperature exceeds a threshold differential compared to the cycle set point temperature of the dryer.

DESCRIPTION OF THE PREFERRED EMBODIMENT

The present invention provides an apparatus and method for suppressing a fire within a clothes dryer. The invention may be utilized in any dryer including a reversing dryer in which the tumbling direction is periodically reversed. The clothes dryer includes a fire protection system which is actuated by the dryer's electronic controller. A temperature sensor monitors the temperature of the tumbler chamber of the dryer and the electronic controller determines the presence of a fire within the dryer based on temperature measurements, and activates a fire suppression system in response to the detection of the fire. A second temperature sensor may be provided to monitor the temperature of the exhaust air, and the electronic controller may also enable the fire suppression system when the exhaust air temperature indicates a fire in the dryer. The tumbler may be activated by the electronic controller after the fire suppression system is activated to aid in the suppression of the fire.

When the clothing dryer cycling has stopped, the electronic controller receives signals from a temperature sensor that successively measures the internal temperature of the tumbler chamber. If a fire has started in the tumbler chamber after the drying cycled has completed, the temperature sensor will produce a signal representing the rising temperature. A program executed by the electronic controller enables the fire suppression system if the temperature within the chamber is rising and the temperature rise exceeds a threshold differential.

When the clothing dryer is operating in a drying cycle, the electronic controller may receive signals from a temperature sensor that successively measures the temperature of the exhaust air of the clothes dryer. The electronic controller enables the fire suppression system if the exhaust air temperature is above a specific set point, or if it exceeds a threshold differential with respect to the cycle set point temperature. Tumbling of the tumbler may also be activated when the fire suppression system is activated.

DETAILED DESCRIPTION OF THE PREFERRED EMBODIMENT

Figure 1:
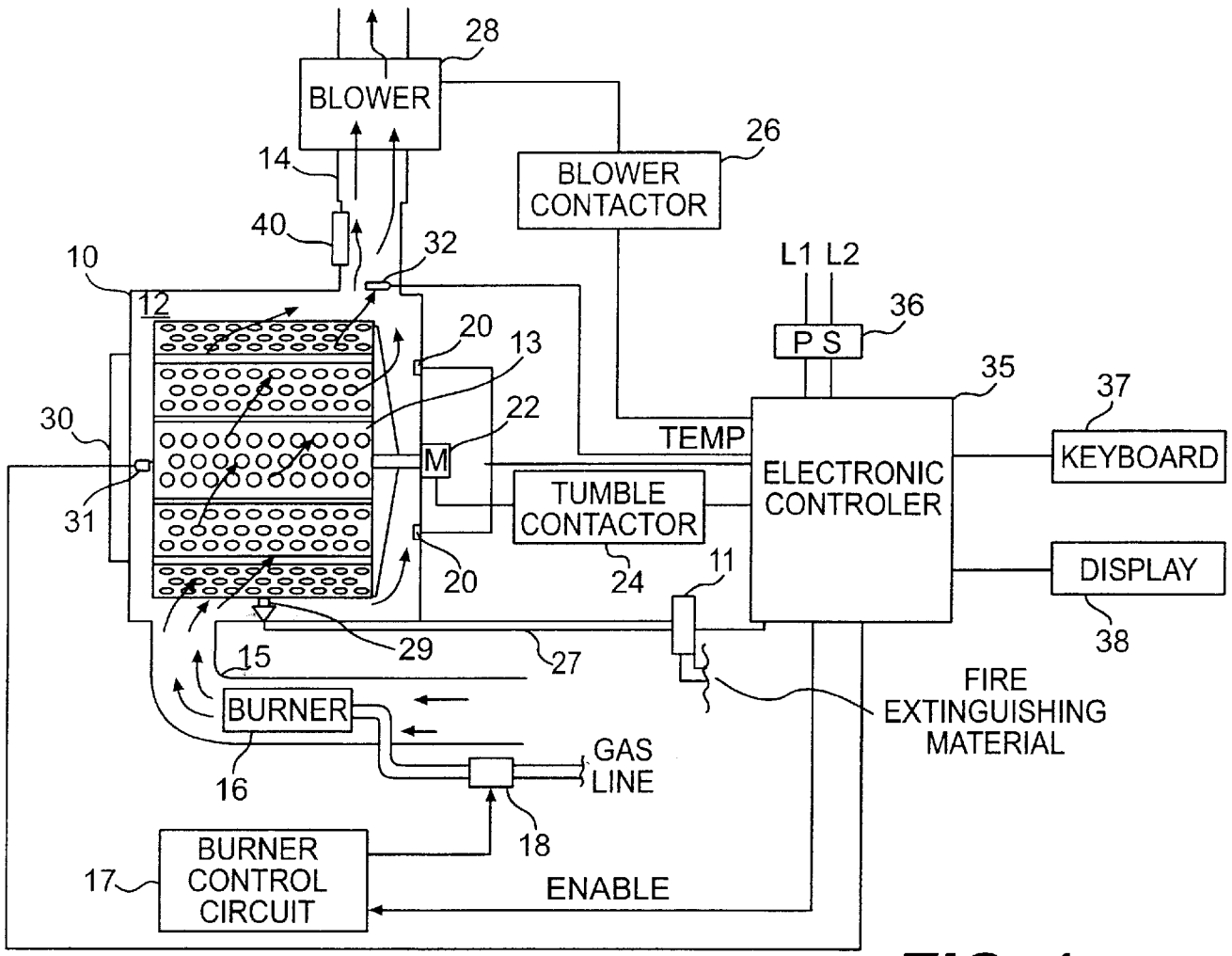
FIG. 1 illustrates a clothes dryer having a fire protection system.

Referring now to FIG. 1, there is shown an embodiment of a clothes dryer 10 having a fire protection system which may employ the fire detection system and method of the present invention. The clothes dryer 10 includes a chamber 12 having an inlet 15 for receiving drying air, from a source of hot air, and an exhaust 14 for removing moisture laden drying air from said chamber 12 using a motor driven blower 28. The blower 28 is arranged at the exhaust 14 and draws air into the chamber 12 through the inlet 15. The clothes dryer 10 includes a tumbler 13 supported for rotation in the drying chamber 10 for rotating a load of wet clothes during drying.

The dryer 10 is controlled by a microprocessor based electronic controller 35. The controller receives user input from the keyboard 37 and provides the user with information such as drying time, temperature, cycle phase, remaining time to dry, etc., on display 38. A temperature sensor 32 located in the drying chamber 12 provides a temperature feedback signal to the electronic controller 35. The dryer blower 28 is controlled through the blower contactor 26 by the electronic controller 35. The drying air temperature is maintained hot by burner 16 which may be a gas fired burner 16 connected through solenoid valve 18 to a source of gas. Electronic controller 35 will enable and disable the burner control circuit 17 in response to a set point setting which is derived by the processor of electronic controller 35, and the measured temperature derived from temperature sensor 32. Power for the dryer components is supplied by power supply 36.

The fire protection system of FIG. 1 includes a temperature sensor 31 for monitoring the internal temperature of the chamber 12 after the drying cycle has completed, and a fire suppression system including a fire suppression system valve 11 connected to a nozzle 29 by conduit 27 for suppressing a fire in the tumbler 13. The sensor 31 may be positioned adjacent the tumbler 13 within the chamber 12 at a location where the temperature is essentially that of the tumbler 13 and supplies a temperature signal to the electronic controller 35. The preferred position of the sensor 31 will be at the highest point within the chamber 12. The electronic controller 35 determines from the temperature sensor 31 whether there is a fire in the tumbler 13, and the electronic controller 35 enables the fire suppression system valve 11 in response to the fire detection.

The electronic controller 35 uses the signal from temperature sensor 32 representing the temperature of the exhaust air when the dryer is cycling to detect a fire in the dryer, and uses the first temperature sensor 31 after the dryer cycle has stopped to detect a fire. The second temperature sensor 32 is positioned to give an accurate measurement of the drying temperature for the air in the chamber 12 by continuously monitoring the temperature of the exhaust air exiting the chamber 12 during the drying cycle. The electronic controller 35 therefore continuously monitors values of temperature for the chamber 12 from the sensors 31, 32, during and after a drying cycle to control the fire suppression system valve 11.

In one embodiment of the present invention, the fire suppression system may include at least one nozzle 29, piping, a fire suppression system valve 11, and a source of fire suppression material. The nozzle 29 is positioned to spray a fire suppression material into the tumbler 13 to extinguish the fire. The nozzle 29 is connected to piping attached to a valve 11 connected to the source of the fire suppression material. The fire suppression material may be water. The nozzle 29 may be positioned to spray the fire suppression material in a mist preferably in a cone shape at about a 120 degree angle within the tumbler 13.

After the fire suppression system valve 11 is activated, the electronic controller 35 may also enable a tumbler drive 22 for tumbling the clothes within the tumbler 13 and to avoid blockage of extinguishing material by a rib of the tumbler 13. The tumbling of the clothes exposes clothes at the bottom of the tumbler 13 to the fire suppression material during tumbling thereby aiding in spraying the clothes with the fire suppression material.

Turning now to FIGS. 2–5, the programming steps executed by the processor of the electronic controller 35 in conjunction with the fire protection system are described in detail. The flow charts represented in FIGS. 2–5 illustrates the procedures for enabling the fire protection system of FIG. 1.

Figure 2:
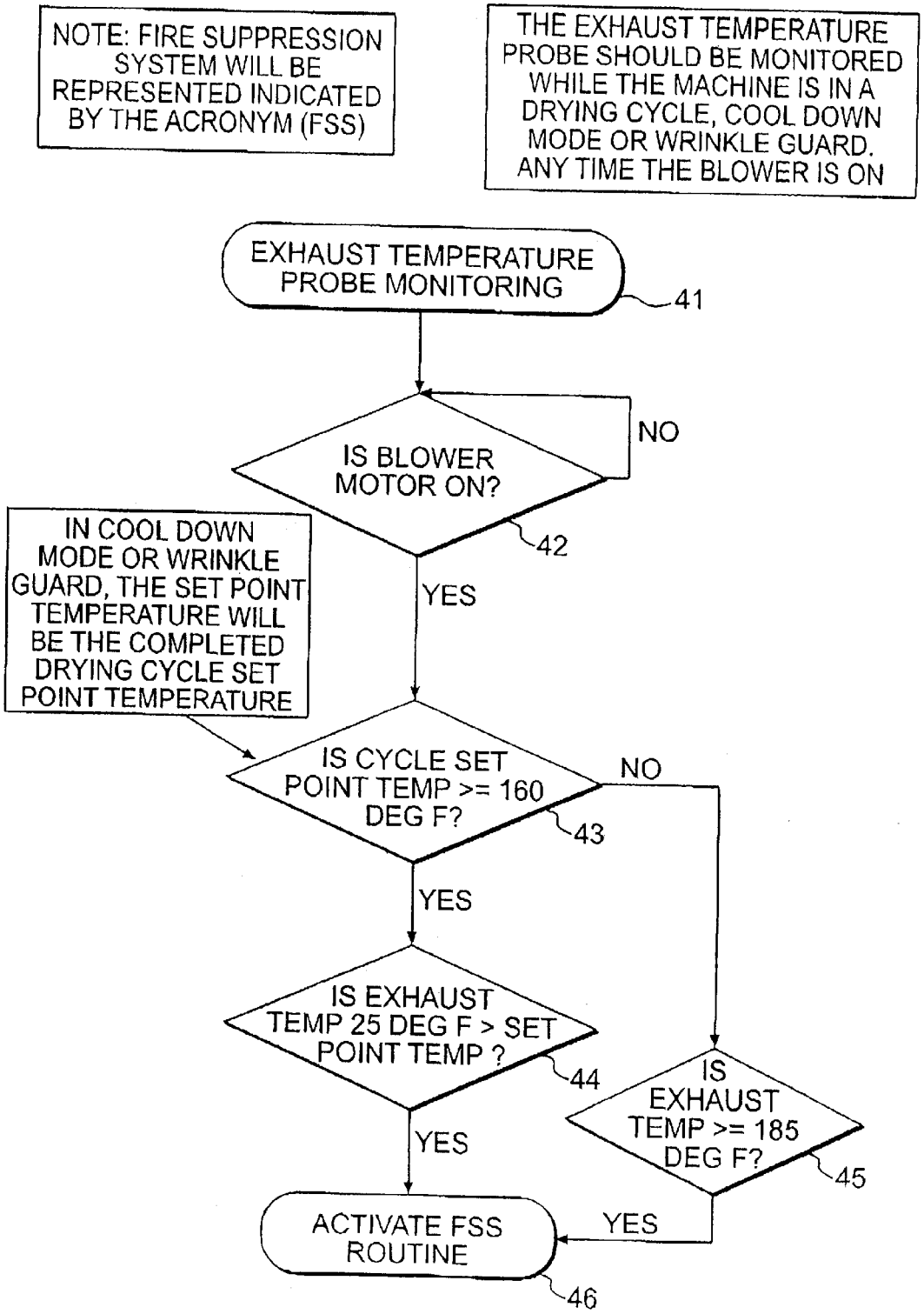
FIG. 2 is flow chart illustrating the fire protection steps carried out by the electronic controller when the dryer is cycling.

The process steps executed by the processor of electronic controller 35 are divided into three basic routines, and a sub-routine. The exhaust temperature monitoring routine of FIG. 2, activates the fire suppression routine (FSS routine) of FIG. 4 based on the temperature readings obtained from the exhaust sensor 32 during the drying cycle. Referring specifically now to FIG. 2, the exhaust temperature sensor monitoring routine (ETSM routine) 41 determines in decision block 42 whether the exhaust blower 28 is activated. If it is, the routine determines in decision block 43 whether the set point temperature for the particular cycle in which the dryer has entered exceeds a given threshold temperature, shown in FIG. 2 to be 160 degrees F. The set point temperature is based on the setting chosen by the user, which is dependent on the materials being dried.

When the cycle set point temperature has been set above the threshold temperature, shown to be 160 degrees F., the exhaust temperature is monitored in decision block 44 and when the exhaust temperature is determined in decision block 44 to exceed a certain temperature differential above the set point temperature, shown to be 25 degrees F., in FIG. 2, the FSS routine is activated in step 46. In the event that the cycle set point temperature is less than 160 degrees F., a different temperature threshold is used to activate the FSS routine 46. Decision block 45 in this circumstance determines whether the exhaust temperature is greater than 185 degrees F., which represents an absolute threshold at which the FSS routine 46 is activated.

Figure 3:
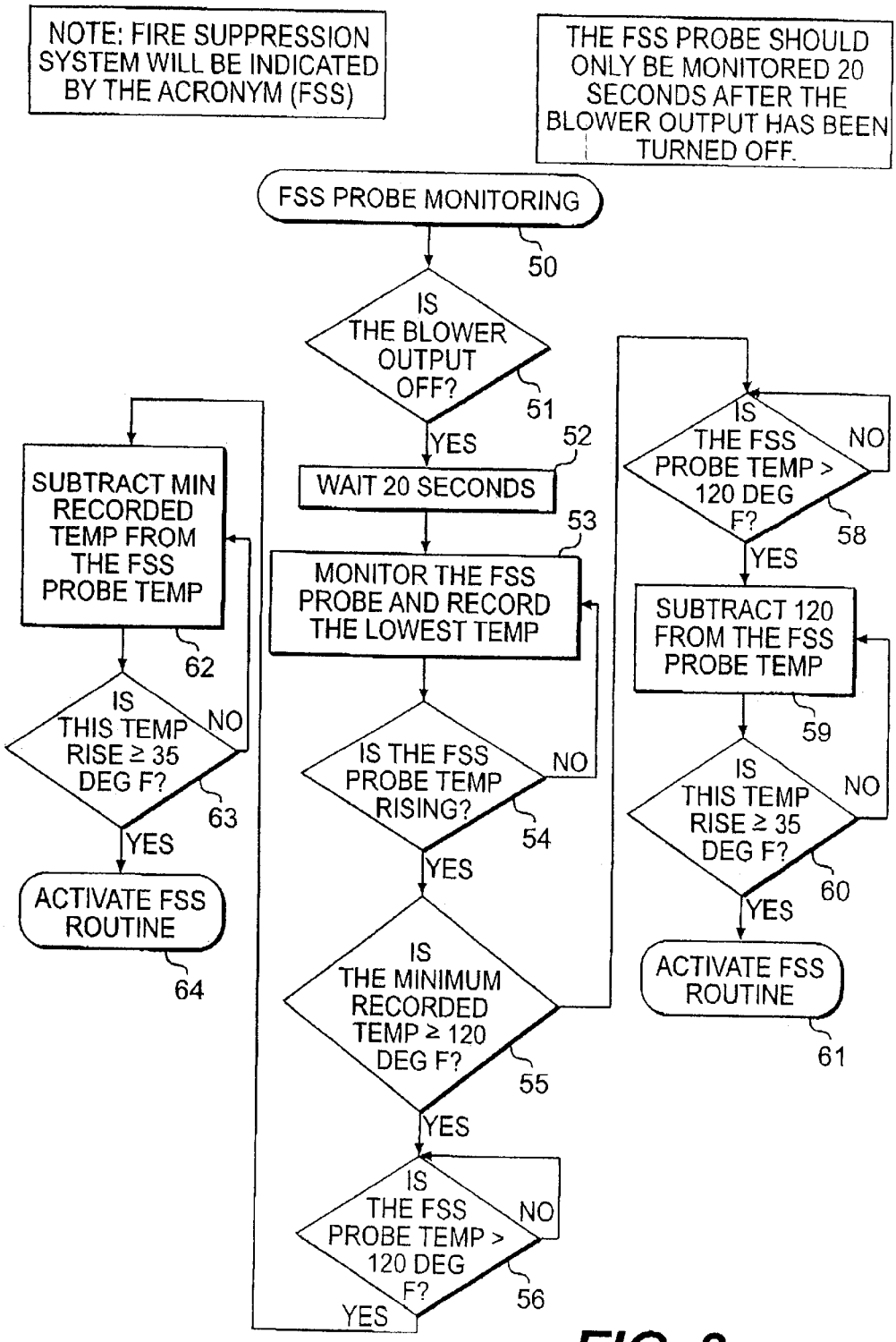
FIG. 3 is flow chart illustrating the fire protection steps carried out by the electronic controller when the dryer cycle is stopped.

FIG. 3 illustrates the fire suppression system probe monitoring routine (FSSPM routine) 50 in detail which is used to detect a fire following a drying cycle. This routine will determine, based on measurements from the sensor 31 whether or not the FSS routine of FIG. 4 should be invoked when the dryer has completed its drying cycle and is stationary.

The FSSPM routine operates when the blower 28 is determined to be off in decision block 51. A delay function is entered in step 52, wherein further processing of the temperature information from sensor 31 continues 20 seconds later.

The electronic controller 35 continuously samples under control of its program instructions the sensor 31 temperature in block 53. Successive values of temperature are thereby obtained, and each value is compared with the previous temperature reading. The lowest of the temperature readings is stored in a register and is used by the system as one of the parameters for determining when the FSS routine should be invoked.

Decision block 54 determines from the successive readings of temperature from sensor 31 whether the sensor temperature is rising. In the event that it is determined to be rising, decision block 55 will determine whether or not the minimum recorded temperature obtained in step 53 exceeds a given temperature threshold, shown to be 120 degrees F.

Processing by using steps 58–61 will determine whether a fire exists based on the temperature rise if the lowest recorded temperature is less than 120 degrees F.

Steps 56, 62–63 will determine whether or not the FSS routine will be executed when the minimum recorded temperature has exceeded the temperature threshold of 120 degrees F. In both circumstances, a temperature increase of 35 degrees F. results following a drying cycle in activation of the FSS routine.

Specifically, when the minimum recorded temperature is less than 120 degrees F., and decision block 58 determines that the sensor temperature is above the first threshold of 120 degrees F., a temperature rise is determined in step 59 by subtracting the first temperature threshold from the measured temperature sensor 31. When decision block 60 determines this temperature rise exceeds a threshold increase of 35 degrees F., the FSS routine is activated in 61 to suppress a fire in the dryer.

In the process described in FIG. 3, when the minimum recorded temperature has exceeded 120 degrees F., a similar set of steps are executed. Decision block 56 determines when the temperature sensor 31 measurement exceeds the first threshold of 120 degrees F. Process step 62 determines the temperature rise between the minimum recorded temperature of step 53, and the current measurement of temperature. When the temperature threshold differential is greater than 35 degrees F., as determined in decision block 63, the FSS routine is activated in step 64 for suppressing what has been determined to be a fire within the tumbler 13.

The foregoing FSSPM routine uses the first threshold temperature, the lowest recorded temperature, to represent a reference temperature condition. In the event that the reference temperature is lower than 120 degrees F., decisions as to whether or not the temperature exceeds the temperature rise threshold are made based on an assumed temperature of 120 degrees F. In the event that the reference temperature is greater than 120 degrees F., then, the lowest recorded temperature, which will be above 120 degrees F., serves as the temperature parameter from which a temperature rise is calculated.

Figure 4:
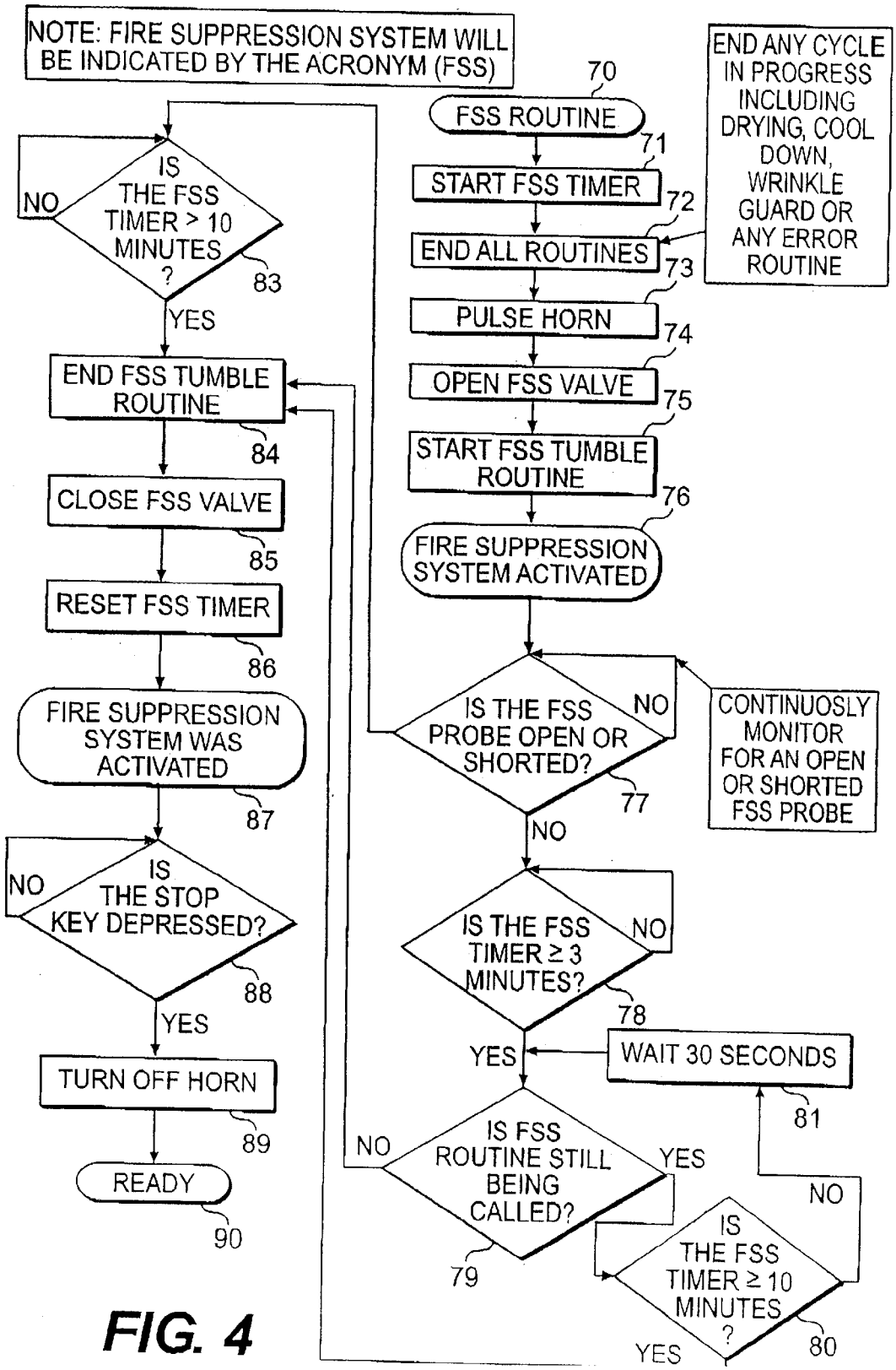
FIG. 4 is flow chart illustrating the steps carried out by the electronic controller when a fire is detected in the tumbler; and, FIG. 5 is flow chart illustrating the subroutine carried out by the electronic controller to tumble the tumbler.

FIG. 4 represents the actual fire suppression routine (FSS routine) 70 for activating the fire suppression system valve 11. The fire suppression routine 70 is entered from instructions executed in the routine of FIG. 2 or FIG. 3. Fire suppression system timer 71 is then activated. All other routines executed by the electronic controller 35 are ended, including any in progress portions of the drying cycle. An alarm is sounded in step 73, and the fire suppression system valve 11 is opened in step 74, to permit the spraying of water, or other fire inhibiting substances on the clothes within the tumbler 13. Additionally, a tumble subroutine 75 is entered, which is shown more particularly with respect to FIG. 5. The tumble subroutine will rotate the tumble drive, in the case of a reversing dryer, to expose the layers of clothes which may be burning.

Once the fire suppression system is activated as shown in step 76, decision block 77 provides an internal check which is conducted by the electronic controller 35 to determine whether or not the temperature sensor 31 is operational, as being either open circuited or short circuited.

If the sensor 31 is operational, the decision block 78 determines whether the fire suppression system timer, which was started in step 71, has timed out to three minutes or more. If it has, decision block 79 determines whether or not the fire suppression routine is still being called by the fire detection routines of FIGS. 2 and 3. If not, indicating that the fire is out, the tumble routine is ended in step 84, the fire suppression valve 11 is closed in step 85, and the timer 71 is reset in step 86. At this point the fire suppression system is deactivated as indicated by 87. In the event that the fire suppression routine is still being called by either the fire detection routines of FIGS. 2 and 3, the timer 71 is again checked in decision block 80 and the delay step of 81. When 10 minutes has passed, the fire suppression system is deactivated through steps 84–87.

If the sensor 31 is not operational, as determined by the decision block 77 internal check of the sensor 31 conducted by the electronic controller 35, decision block 83 is entered. Decision block 83 determines when the timer 71 has been activated for over 10 minutes. When ten minutes have passed, the fire suppression system is deactivated through steps 84–87.

The fire suppression system routine may still be being called for longer than ten minutes, if the sensor 31 is not operational, for example if the sensor 31 is shorted or opened during the fire. If the sensor 31 is not operational, the fire suppression routine will remain active for a minimum of ten minutes and then the fire suppression system is deactivated through steps 84–87.

A user deactivates the dryer, fire protection system through keyboard 37 to stop the alarm. When the user has deactivated the system as determined in decision block 88, the horn is turned off in step 89 and the dryer is shown to be in a ready condition in step 90 by displaying appropriate indicia on display 38.

Figure 5:
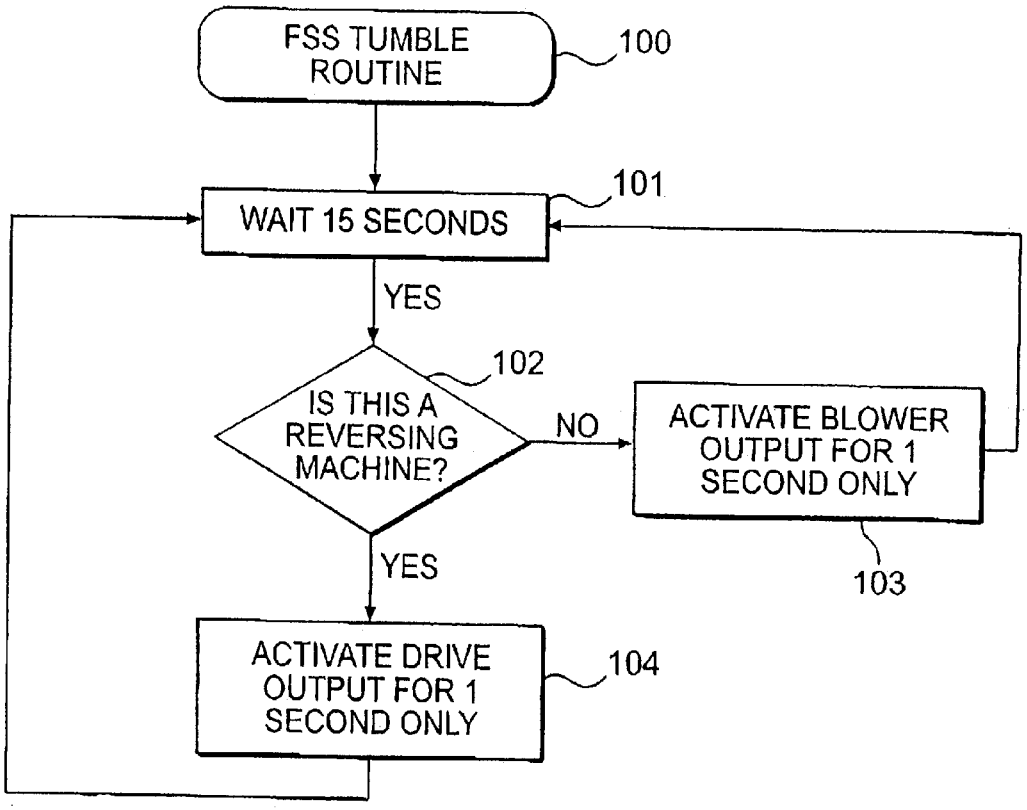

FIG. 5 shows the fire suppression system tumble subroutine in greater detail. The sub-routine 100 is entered, and after a delay of 15 seconds as is set by step 101, a determination is made in block 102 if the machine is a reversing machine. If so, the tumbler forward output is activated for a brief period of time, shown to be one second in step 104 exposing the clothes to the fire suppression material being injected by the fire suppression system and to avoid blockage of the extinguishing material by a rib of the tumbler. The routine then waits for 15 seconds and repeats the cycle.

If the dryer is not a reversing type machine, as determined in 102, the exhaust blower 28 is operated for a short time period to therein tumble the tumbler 13, since the exhaust blower is mechanically linked to the tumbler. Activating the exhaust blower 28 therein activates the tumbler 13. The exhaust blower 28 may be operated for about 1 second. The routine then waits for 15 seconds and repeats the cycle.

The foregoing description of the invention illustrates and describes the present invention. Additionally, the disclosure shows and describes only the preferred embodiments of the invention but, as mentioned above, it is to be understood that the invention is capable of use in various other combinations, modifications, and environments and is capable of changes or modifications within the scope of the inventive concept as expressed herein, commensurate with the above teachings and/or the skill or knowledge of the relevant art. The embodiments described hereinabove are further intended to explain best modes known of practicing the invention and to enable others skilled in the art to utilize the invention in such, or other, embodiments and with the various modifications required by the particular applications or uses of the invention. Accordingly, the description is not intended to limit the invention to the form disclosed herein. Also, it is intended that the appended claims be construed to include alternative embodiments.

What is claimed is:

1. A clothes dryer having fire protection comprising:

a drying chamber having an inlet for receiving heated air and an exhaust for removing moisture laden air;

a tumbler supported for rotation in said drying chamber for receiving clothes to be dried;

a sensor for monitoring the internal temperature of said drying chamber;

a fire suppression system for suppressing a fire in said tumbler; and an electronic controller connected to said sensor and said fire suppression system, said controller having a processor program to:

(a) determine the internal temperature of said tumbler;

(b) determining whether the temperature is increasing over time;

(c) determining, based upon a determined increase in temperature, whether a fire exists in said tumbler; and (d) activating said fire suppression system when a fire is detected and tumbling said clothes.

2. The clothes dryer according to claim 1 wherein said electronic controller is programmed to:

successively measure the temperature of said drying chamber;

compare each measured temperature;

determine for each of said measured temperatures whether said temperatures are rising with time; and activate said fire suppression system when a measured temperature rise exceeds a temperature threshold differential.

3. The clothes dryer according to claim 2 further comprising the steps of:

determining the minimum measured temperature of said drying chamber among said successive temperature measurements;

when said successive temperature measurements are rising, determining whether said minimum measured temperature is greater than a first threshold temperature; and when said minimum successive temperature is greater than said first threshold temperature, and said measured temperature is greater than said threshold temperature, subtracting said minimum measured threshold temperature from said measured temperature to derive said measured temperature rise.

4. The clothes dryer according to claim 3 further comprising:

when said minimum measured temperature is less than said threshold temperature, and said measured temperature is greater than said threshold temperature, subtracting said first threshold temperature from said sensor temperature to derive said measured temperature rise.

5. The clothes dryer according to claim 2 wherein said temperature rise is at least 35 degrees F.

6. The clothes dryer according to claim 2 wherein said programming steps are executed when said dryer is not producing heat.

7. The clothes dryer according to claim 1 wherein said electronic controller determines whether an exhaust blower is enabled before making a determination that a fire exists in said tumbler.

8. The clothes dryer according to claim 1 wherein said electronic controller is further programmed to:

start a timing interval when said fire is determined from said temperature sensor measurements;

when said timing interval exceeds a first timing threshold, disabling said fire suppression system if said sensor temperature no longer indicates a fire is present.

9. The clothes dryer according to claim 8 wherein said electronic controller is further programmed to disable said fire suppression system when said timing interval exceeds a second interval, and said electronic controller continues to determine from said sensor temperature that a fire is present.

10. The clothes dryer according to claim 9 wherein said tumbler is activated for a predetermined period of time.

11. The clothes dryer according to claim 1 wherein said electronic controller activates an exhaust blower to therein tumble said tumbler when said fire suppression system is activated.

12. The clothes dryer according to claim 1 comprising:

a second temperature sensor for measuring the temperature of air passing through said exhaust, connected to said electronic controller, said electronic controller activating said fire suppression system if said exhaust air temperature indicates a fire is present in said tumbler.

13. A clothes dryer having fire protection comprising:

a drying chamber having an inlet for receiving heated air and an exhaust for removing moisture laden air;

a tumbler supported for rotation in said drying chamber for receiving clothes to be dried;

a first sensor for monitoring the internal temperature of said drying chamber;

a fire suppression system for suppressing a fire in said tumbler;

a second sensor for monitoring said exhaust air temperature; and an electronic controller connected to said first and second sensor and said fire suppression system said electronic controller detecting from signals produced by said first and second sensors a fire in said tumbler and enabling said fire suppression system in response to said detection, said controller having a processor programmed to:

(a) invoke a fire suppression routine when said exhaust air temperature exceeds a predefined temperature comprising:

(b) determining the internal temperature of said tumbler;

(c) determining whether the temperature is increasing over time; and (d) determining, based upon a determined increase in temperature, whether a fire exists in said tumbler; and (e) activating said fire suppression system when a fire is detected while tumbling said clothes.

14. The clothes dryer according to claim 13 wherein said electronic controller is programmed to:

successively measure the temperature of said chamber from said first temperature sensor;

compare each measured temperature from said first sensor;

determine for each of said measured temperatures whether said temperatures are rising with time; and activate said fire suppression system when a measured temperature rise exceeds a temperature threshold differential.

15. The clothes dryer according to claim 14 wherein said clothes dryer electronic controller is further programmed to:

determine the minimum measured temperature of said chamber among said successive temperature measurements;

when said successive temperature measurements are rising, determining whether said minimum measured temperature is greater than a first threshold temperature; and when said minimum successive temperature is greater than said first threshold temperature, and said measured temperature is greater than said threshold temperature, subtracting said minimum measured threshold temperature from said measured temperature to derive said measured temperature rise.

16. The clothes dryer according to claim 15 wherein said electronic controller is further programmed to:

subtract said first reference value from said sensors temperature to derive said measured temperature rise when said minimum measured temperature is less than said threshold temperature, and said measured temperature is greater than said threshold temperature.

* * * * *